US007095865B2

(12) United States Patent
Katayama et al.

(10) Patent No.: US 7,095,865 B2
(45) Date of Patent: Aug. 22, 2006

(54) AUDIO AMPLIFIER UNIT

(75) Inventors: Masaki Katayama, Hamamatsu (JP); Hirofumi Onitsuka, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/356,548

(22) Filed: Feb. 3, 2003

(65) Prior Publication Data

US 2003/0147543 A1 Aug. 7, 2003

(30) Foreign Application Priority Data

Feb. 4, 2002 (JP) ..... 2002-027094

(51) Int. Cl.
*H04R 5/00* (2006.01)
*H04R 5/02* (2006.01)

(52) U.S. Cl. ..... 381/309; 381/26; 381/307

(58) Field of Classification Search ..... 381/1, 381/17, 18, 307, 309, 310, 26, 74
See application file for complete search history.

(56) References Cited

U.S. PATENT DOCUMENTS 3,962,543 A * 6/1976 Blauert et al. ..... 381/310
5,696,831 A * 12/1997 Inanaga et al. ..... 381/309
5,717,767 A * 2/1998 Inanaga et al. ..... 381/309
5,844,816 A * 12/1998 Inanaga et al. ..... 702/145
6,731,759 B1 * 5/2004 Terai et al. ..... 381/17
6,741,273 B1 * 5/2004 Waters et al. ..... 348/61
2003/0031334 A1 * 2/2003 Layton et al. ..... 381/310
2003/0138107 A1 * 7/2003 Jin et al. ..... 381/17
2004/0091119 A1 * 5/2004 Duraiswami et al. ..... 381/26

* cited by examiner

*Primary Examiner*—Xu Mei
(74) *Attorney, Agent, or Firm*—Reed Smith LLP; Stanley P. Fisher, Esq.; Juan Carlos A. Marquez, Esq.

(57) ABSTRACT

Face of a listener (user) is photographed by a CCD camera, and a face width and auricle size of the listener are detected on the basis of the picture of the listener's face. Head-related transfer functions, which are transfer functions of sounds propagated from virtual rear loudspeakers to both ears of the listener, are calculated, using the detected face width and auricle size as head shape data of the listener. Then, a filter process is performed by a DSP of a USB amplifier unit so as to attain characteristics of the head-related transfer functions, as a result of which sound image localization of the rear loudspeakers can be achieved via front loudspeakers.

9 Claims, 14 Drawing Sheets

STANDARD MODEL

FACE WIDTH = 148mm

EAR LENGTH ≒ 60mm

EAR NEAR
AUDIO SOURCE

EAR FAR
FROM AUDIO SOURCE

EAR NEAR
AUDIO SOURCE

EAR FAR
FROM AUDIO SOURCE

AUDIO AMPLIFIER UNIT

BACKGROUND OF THE INVENTION

The present invention relates to audio amplifier units which output audio signals of rear loudspeakers to channels of front loudspeakers.

Among various recent audio (video) sources, such as DVD Video disks (DVDs), are ones having recorded thereon 5.1-channel or other type of multi-channel audio signals with a view to enhancing a feeling of presence or realism. For example, audio amplifiers and loudspeakers of six channels are normally required for reproduction of 5.1-channel audio signals.

Also, in recent years, it is getting more and more popular to reproduce AV (AudioVisual) software, such as software recorded on a DVD, via a personal computer. In such cases, the multi-channel audio signals are usually reproduced through a pair of left (L) and right (R) channels, because the personal computer is rarely connected to a multi-channel audio system capable of appropriately reproducing 5.1-channel audio signals. However, thus reproducing the multi-channel audio signals by only the two channels can not reproduce a feeling of presence or realism to a satisfactory degree.

Further, there has been proposed a technique which outputs audio signals of rear (surround) channels via front loudspeakers, i.e. front L- and R-channel loudspeakers after performing a filter process on the audio signals of the rear channels to allow their sound images to be localized at virtual rear loudspeaker positions. But, the proposed technique would present the inconvenience that it can not achieve accurate sound image localization because filter coefficients and other parameters employed are fixed.

Namely, although sound image localization perceived by a human listener depends greatly on head-related transfer functions that represent audio-signal transfer characteristics determined by a shape of the head of a human listener, the conventional apparatus for simulating multi-channel audios are generally arranged to only simulate head-related transfer functions of a predetermined head shape; namely, they never allow for different head shapes of various human listeners.

SUMMARY OF THE INVENTION

In view of the foregoing, it is an object of the present invention to provide an improved audio amplifier unit which is constructed with different head shapes of various human listeners taken into consideration and thereby allows a sound image of a rear-channel audio signal to be accurately localized at a virtual rear loudspeaker position even when the rear-channel audio signal is output via front loudspeakers.

In order to accomplish the above-mentioned object, the present invention provides an audio amplifier unit for connection thereto of loudspeakers of front left and right channels to be installed in front of a human listener, which comprises: a filter section that receives multi-channel audio signals including at least audio signals of the front left, and front right and rear channels and performs a filter process on the audio signal of the rear channel so as to allow the audio signal of the rear channel to be virtually localized at a virtual loudspeaker position of the rear channel; a head shape detection section that detects a head shape of the listener to generate head shape data; a filter coefficient supply section that supplies said filter section with filter coefficients for simulating characteristics of sound transfer from the virtual loudspeaker position of the rear channel to ears of the listener, the characteristics corresponding to the head shape data generated by said head shape detection section; and an output section that provides an output of the filter section to a pair of loudspeakers for front left and right channels.

In an embodiment of the invention, the head shape data represent a face width and auricle size (length) of the listener.

Preferably, the head shape detection section includes a camera for taking a picture of the face of the listener, and a picture processing section that extracts predetermined head shape data from the picture of the face taken by the camera.

In a preferred implementation, the head shape detection section is provided in a personal computer externally connected to the audio amplifier unit, and the personal computer supplies the multi-channel audio signals to the audio amplifier unit.

This and following paragraphs explains a 5.1-channel multi-audio system that is a typical example of multi-audio systems known today. The 5.1-channel multi-audio system includes six loudspeakers, i.e. front left and rear loudspeakers L, R, rear left and right (surround) loudspeakers Ls, Rs, center loudspeaker C and subwoofer loudspeaker Sw, arranged in a layout as shown in FIG. 1, and this 5.1-channel multi-audio system produces a sound field full of a feeling of presence or realism by supplying audio signals of respective independent channels to these loudspeakers. However, in the case of a small-scale 5.1-channel multi-audio system for use at home or the like, the six loudspeakers are generally too large for the home or the like and occupies too much space, and thus it has been conventional to install only four loudspeakers, i.e. front left and right loudspeakers L, R and rear left and right loudspeakers Ls, Rs and distributively supply audio signals of the omitted subwoofer and center loudspeakers to the L and R channels. Because it is only necessary that a sound image of the audio signal for the center loudspeaker be localized centrally between the front left and right loudspeakers L and R and because sound image localization of the audio signal for the subwoofer loudspeaker matters little here, the 5.1-channel multi-audio system can be readily modified into a four-loudspeaker system.

In a case where sound images of audio signals for the rear left and right (surround) loudspeakers Ls and Rs are to be localized at the virtual rear left and right loudspeaker positions by outputting these audio signals through the front left and right loudspeakers L and R, there is a need to convert frequency characteristics and time differences of the audio signals into those of sounds actually heard from behind a listener.

Namely, each human listener has empirically learned to estimate a direction, distance etc. of a sound on the basis of a time difference and frequency component difference between portions of the sound heard by the left and right ears. Thus, where a so-called virtual loudspeaker unit is to be implemented which allows respective sound images of audio signals for the rear left and right loudspeakers Ls and Rs to be localized at the virtual rear left and right loudspeaker positions by outputting these audio signals via the front left and right loudspeakers L and R, it is necessary to perform a filter process on the audio signals for the rear left and right loudspeakers Ls and Rs to assume such time differences and frequency components as if the audio signals were actually output through the rear loudspeakers, and then output the thus filter-processed audio signals to the front loudspeakers.

Namely, by causing audio signals for the rear left and right loudspeakers to be output through the front loudspeakers after processing the audio signals to assume substantially the same time differences and frequency characteristics as in the case where the audio signals are actually output through the rear loudspeakers to reach the listener's ears, it is possible to implement a virtual loudspeaker unit which outputs audio signals for the rear left and right loudspeakers via the front loudspeakers in such a manner that their respective sound images can be localized appropriately at the virtual rear left and right loudspeaker positions. However, it is known that time differences and frequency characteristics with which audio signals output via rear loudspeakers reach human listener's ears tend to greatly vary depending on the shape of the listener's head, and, in general, each human listener has empirically learned to estimate a direction and distance of a sound once he or she hears the sound with a time difference and frequency characteristics having been modified or influenced by his or her unique head shape.

Therefore, in the case where sound images of audio signals for the rear left and right loudspeakers are to be localized at virtual rear left and right loudspeaker positions by outputting these audio signals via the front left and right loudspeakers, there arises a need to set, in a filter unit, filter coefficients (head-related transfer functions) reflecting a head shape of a listener.

Thus, the present invention is arranged to achieve accurate sound image localization (virtual loudspeaker unit) in accordance with unique physical characteristics of each human listener.

In one preferred implementation, a width of the listener's face and a size of the listener's auricle are used as head shape data representative of the listener's head shape. This is because, in the case of a sound arriving from behind the human listener, the width of the listener's face greatly influences a peak shape of frequency characteristics and the size of the listener's auricle greatly influences a received sound level. Thus, using these factors as the head shape data, characteristics of the head shape can be expressed sufficiently with a small number of factors.

The following paragraphs describe relationship between a face width and auricle sizes of a human listener and frequency characteristics (head-related transfer functions) of a sound reaching the listener's ears in a case where the virtual rear loudspeakers are implemented by the front loudspeakers.

First, let's consider characteristics with which an audio signal audibly output from a rear loudspeaker, installed at an angle θ from a right-in-front-of-listener direction shown in FIG. 1B, reaches the listener. In FIGS. 2A and 2B, there is illustrated a standard model of a human listener's head shape. Assume here that the listener's head of FIGS. 2A and 2B has a face width of 148 mm and an auricle size (i.e., auricle length) of 60 mm. Further, FIGS. 3A and 3B show with what characteristics a sound is propagated from a rear left audio source to the left ear (in this example, near-audio-source ear or "near ear") and right ear (in this example, far-audio-source ear or "far ear"), using such a standard model. The graphs of FIGS. 3A and 3B show respective measurements of frequency characteristics, i.e. head-related transfer functions, obtained when the installed angle θ was set to 90°, 114°, 120°, 126° and 132°. As seen from FIG. 3B, frequency components, higher than 5,000 Hz, of the sound propagated to the far ear present great attenuation; particularly, the attenuation gets greater as the installed angle θ of the rear loudspeaker increases, i.e. as the installed position of the rear loudspeaker gets closer to a direction right behind the listener (right-behind-listener direction). Namely, the frequency characteristics (and delay times) vary depending on the installed angle of the rear audio source, and the listener estimates the direction of the audio source on the basis of the frequency characteristics.

Next, let's consider how the frequency characteristics vary due to a difference in the head shape, in relation to a case where the rear audio source (rear loudspeaker) is fixed at a 120° installation angle commonly recommended for 5.1-channel multi-audio systems.

FIGS. 4A to 4C are diagrams explanatory of various head-related transfer functions corresponding to various ear (auricle) sizes. Specifically, these figures show a variation in the head-related transfer functions, in regard to three ear sizes (i.e., auricle lengths), i.e. 90%, 110% and 130% of the ear size (i.e., auricle length) of the standard model (see FIG. 2). Namely, the figures show that a sound level difference between the far ear and the near ear increases as the size of the auricle increases. Further, FIGS. 5A to 5C show a variation in the head-related transfer functions, in regard to three face widths, i.e. 70%, 110% and 160% of the face width of the standard model (see FIG. 2). From the figures, it is seen that, as the face width gets bigger, attenuation of high-frequency components in the far ear increases and peak characteristics of the frequency spectrum shift more remarkably. Namely, the head-related transfer functions, i.e. characteristics of a sound propagated from the rear audio source to the listener's ears, differ in accordance with the head shape of the listener, and thus, if filter coefficients for simulating the head-related transfer functions corresponding to the head shape is set in the filter unit to perform a filter process based thereon, an audio signal for a virtual loudspeaker of a rear channel can be localized appropriately with an increased accuracy.

The following will describe embodiments of the present invention, but it should be appreciated that the present invention is not limited to the described embodiments and various modifications of the invention are possible without departing from the basic principles of the invention. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Figure 1A:
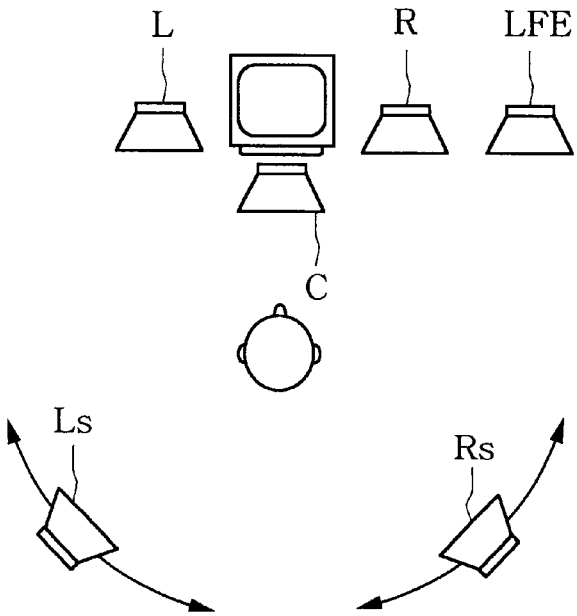
FIGS. 1A and 1B are diagrams showing an example of a multi-channel audio system to which is applied an audio amplifier unit of the present invention.
Figure 1B:
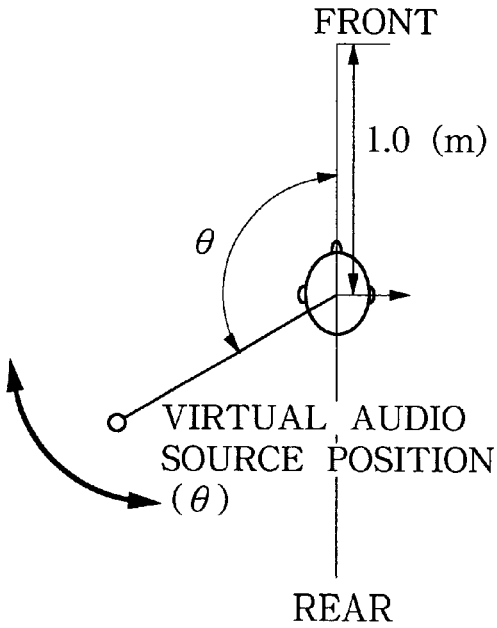
Figure 2A:
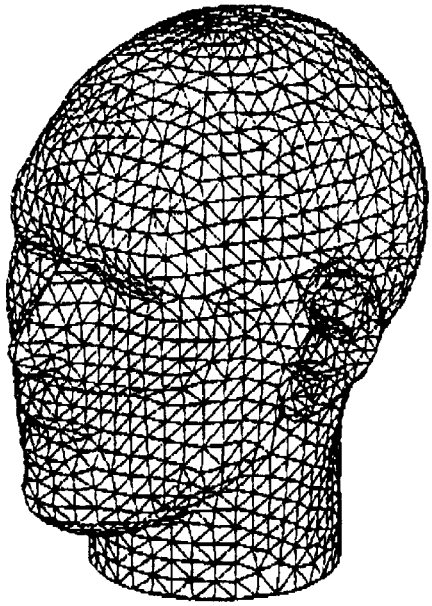
FIGS. 2A and 2B are diagrams explanatory of a head model and settings to be used for determining head-related transfer functions.
Figure 2B:
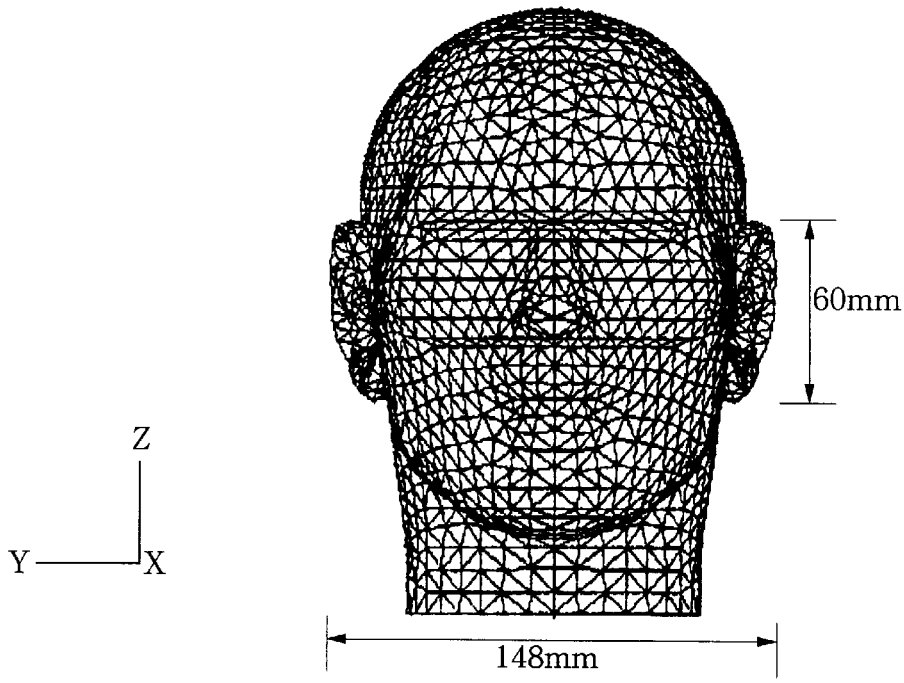
Figure 3A:
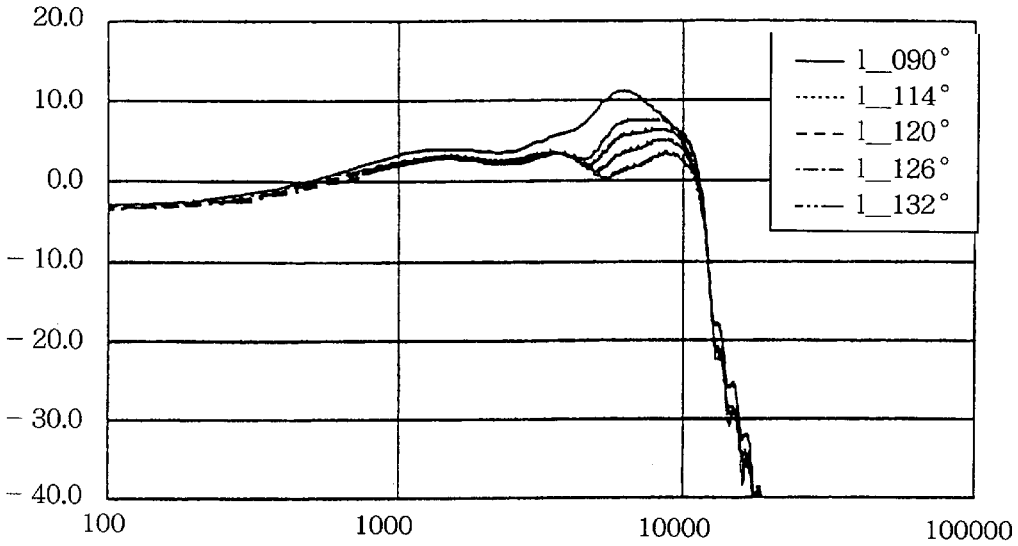
FIGS. 3A and 3B are diagrams showing frequency characteristics of a sound of a rear audio source having reached a near-audio-source ear (near ear) and far-from-audio-source ear (far ear) of a human listener.
Figure 3B:
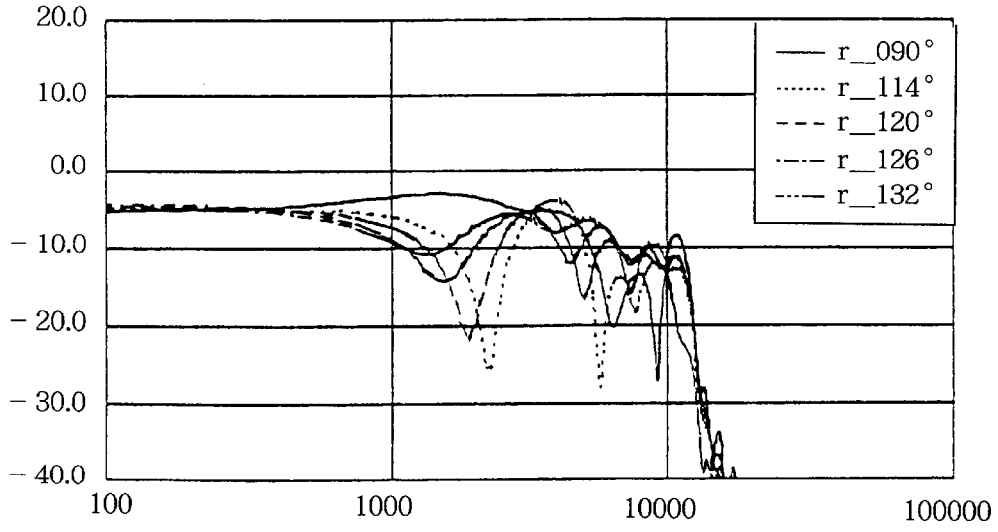
Figure 4A:
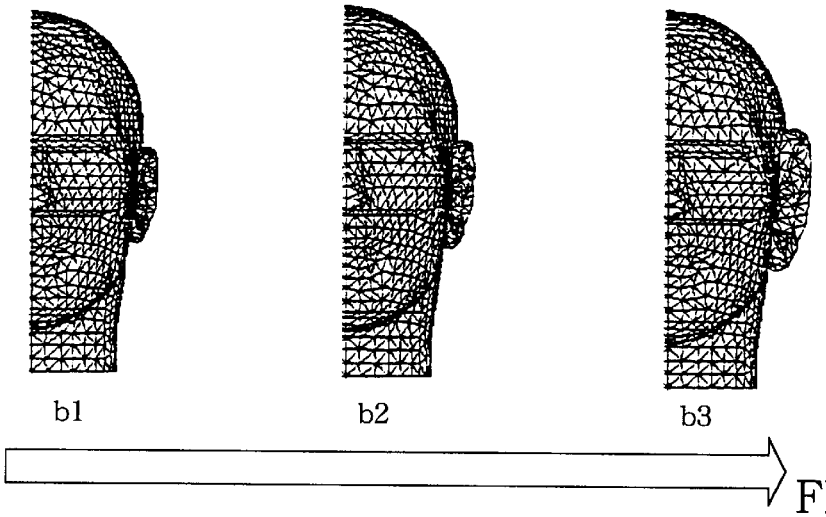
FIGS. 4A to 4C are diagrams explanatory of differences, in frequency characteristics of a sound having reached the near and far ears, resulting from different sizes of the ears.
Figure 4B:
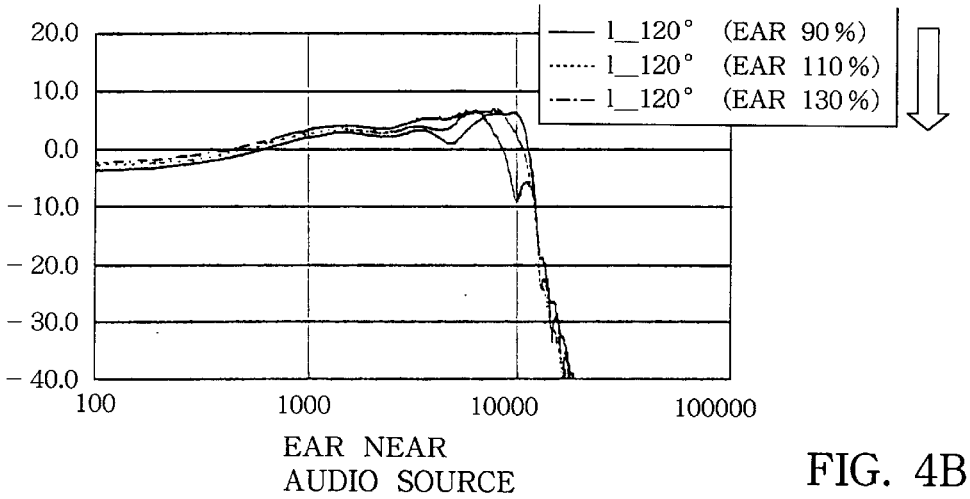
Figure 4C:
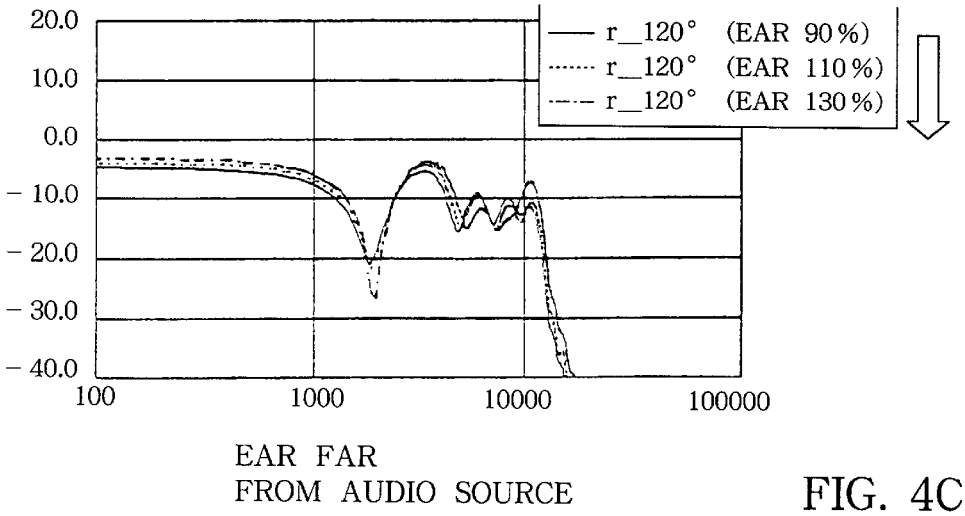
Figure 5A:
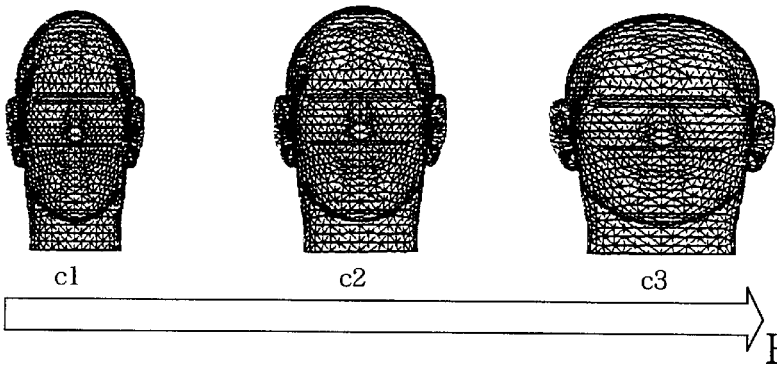
FIGS. 5A to 5C are diagrams explanatory of differences, in frequency characteristics of a sound having reached the near and far ears, resulting from different face widths.
Figure 5B:
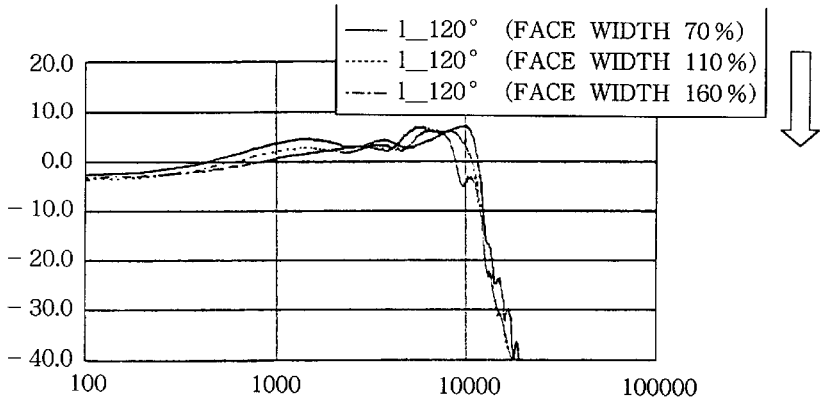
Figure 5C:
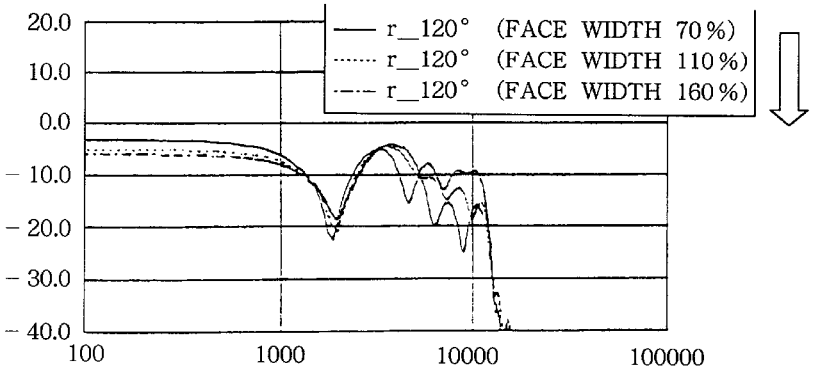
Figure 6:
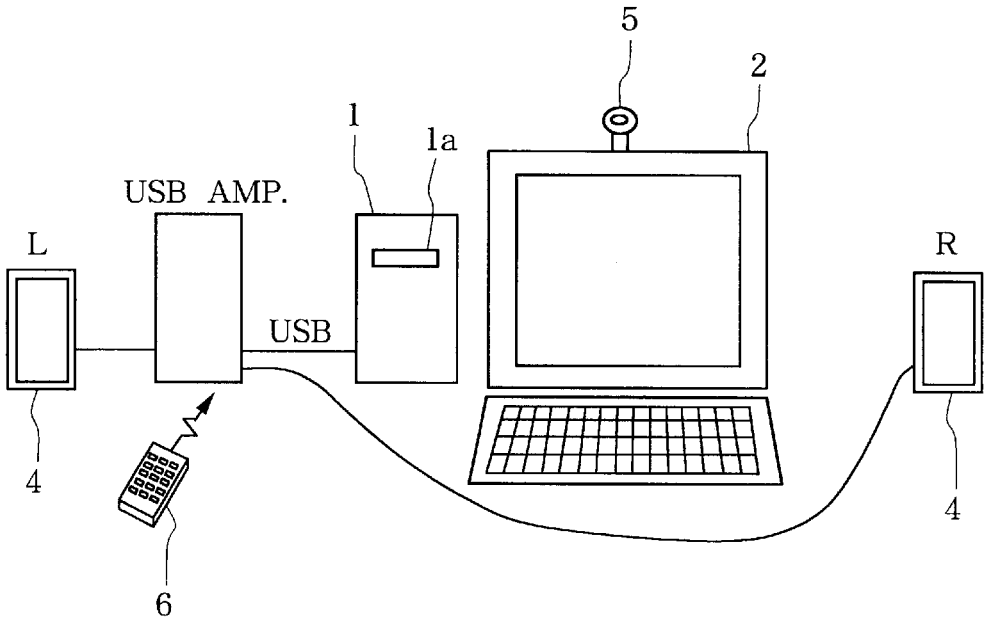
FIG. 6 is a block diagram showing a general setup of a personal computer system employing a USB amplifier unit embodying the present invention.

FIG. 6 shows a general setup of a personal computer audio system employing an embodiment of the present invention. The personal computer audio system includes a main body 1 of a personal computer (including a keyboard and mouse), a monitor 2, a USB amplifier unit 3, loudspeakers 4 of front L (left) and R (right) channels (4L and 4R), and a CCD camera 5. The personal computer main body 1 includes a DVD drive 1*a* for reproducing multi-channel audio signals. Remote controller 6 is provided for a user to instruct the USB amplifier unit 3 to perform desired operations. The USB amplifier unit 3 corresponds to an audio amplifier unit of the present invention, which implements virtual rear loudspeakers (specifically, sound image localization of the virtual rear loudspeakers) by receiving 5.1-channel audio signals and outputting these audio signals via the loudspeakers 4 of the two front channels.

Figure 7:
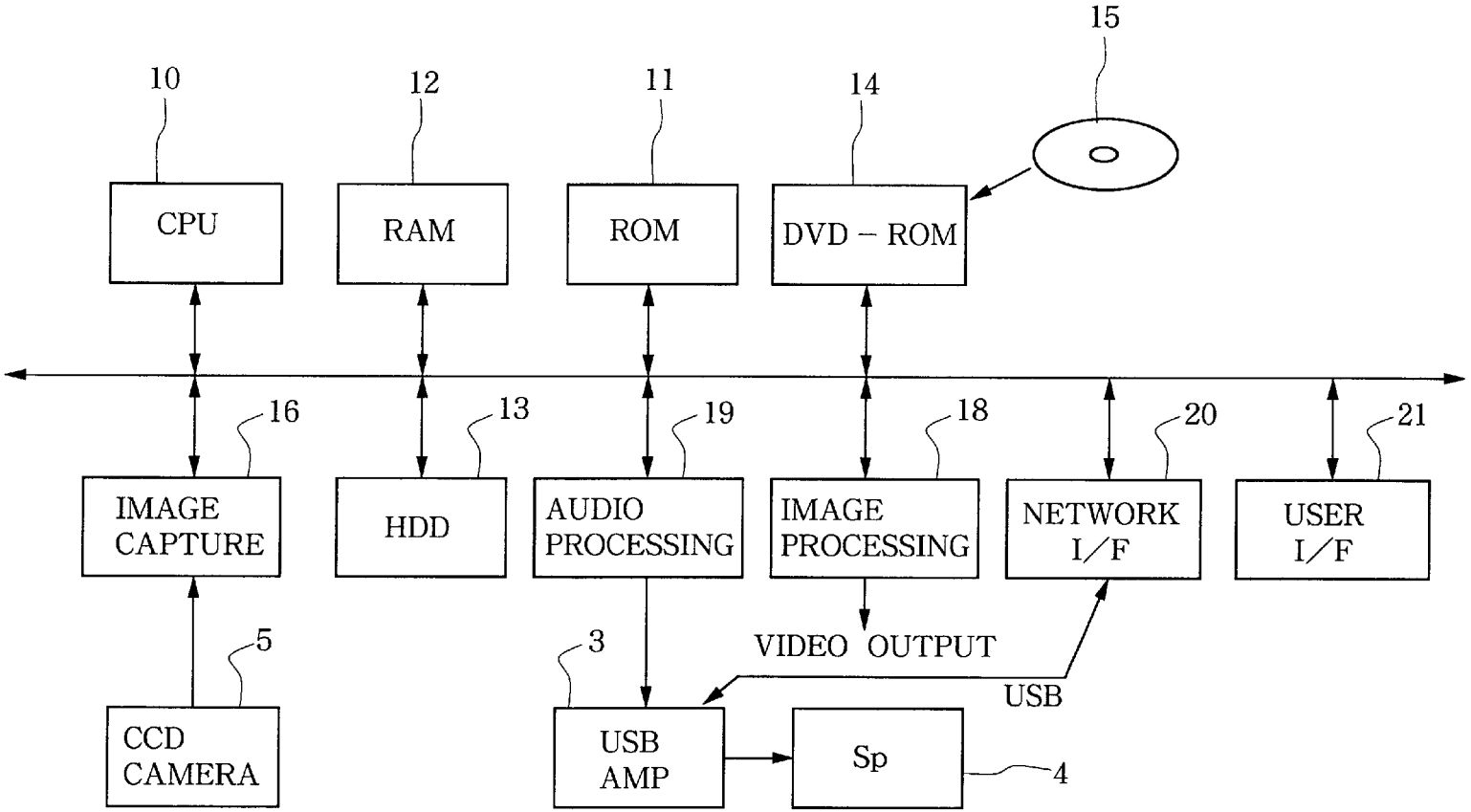
FIG. 7 is a block diagram showing a setup of a main body of the personal computer.

FIG. 7 is a block diagram showing a setup of the personal computer main body 1. The personal computer main body 1 includes a CPU 10, to which are connected, via an internal bus, a ROM 11, a RAM 12, a hard disk 13, a DVD drive 14, an image capture circuit (image capture board) 16, an image processing circuit (video board) 18, a audio processing circuit (audio board) 19, a USB interface 20, a user interface 21, etc.

The ROM 11 have stored therein a start-up program for the personal computer, etc. Upon powering-on of the personal computer, the CPU 10 first executes the start-up program and loads a system program from the hard disk 13. In the RAM 12, there are loaded the system program, application program, etc. The RAM 12 is also used as a buffer memory at the time of audio reproduction. Program files, such as the system program and application programs, are written onto the hard disk 13, and the CPU 10 reads out any of the programs from the hard disk 13 and loads the read-out program into the RAM 12 as necessary.

In the DVD drive 14 (1*a*), there is set a DVD medium having multi-channel audio data recorded thereon. The thus-set DVD medium is reproduced via a reproducing program incorporated in the system program, or via a separate DVD-reproducing application program. Image reproduced from the DVD medium is passed via the image processing circuit 18 to the monitor 2. Multi-channel audio signals reproduced from the DVD medium are supplied via the audio processing circuit 19 to the USB amplifier unit 3. The USB amplifier unit 3 combines the supplied multi-channel audio signals into a pair of front L and R channels and outputs the resultant combined signals to the loudspeakers 4L and 4R.

The CCD camera 5, which is connected to the image capture circuit 16, is intended to take a photograph of the face of a user of the personal computer, namely, a human listener of multi-channel audios recorded on the DVD medium. Shape of the head of the human listener is detected on the basis of the photograph of the face taken by the CCD camera 5, and head shape data are generated on the basis of the thus-detected head shape. Filter coefficients and delay times, to be used for simulating head-related transfer functions corresponding to the head shape data, are then set in the USB amplifier unit 3. In the instant embodiment, data indicative of a width of the face and a vertical dimension (length) of the auricle are used as the head shape data.

The USB amplifier unit 3 is designed to achieve virtual loudspeaker effects by performing a filter process on audio signals of rear L and R surround channels, included in the supplied 5.1-channel audio signals, in accordance with the above-mentioned filter coefficients and delay times for simulating head-related transfer functions, and it outputs the thus filter-processed audio signals of the rear L and R surround channels to the front loudspeakers 4L and 4R in such a manner that sound images of the rear L and R surround channels are localized at virtual rear loudspeaker positions.

Figure 8A:
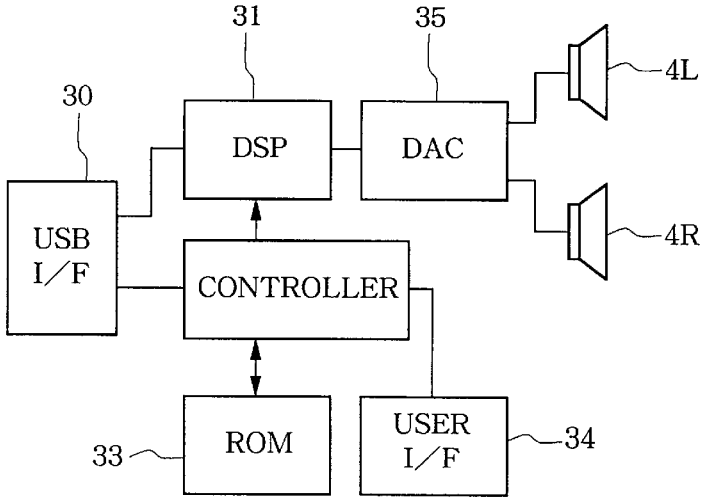
FIGS. 8A and 8B are block diagrams showing an exemplary structure of the USB amplifier unit of the present invention.
Figure 8B:
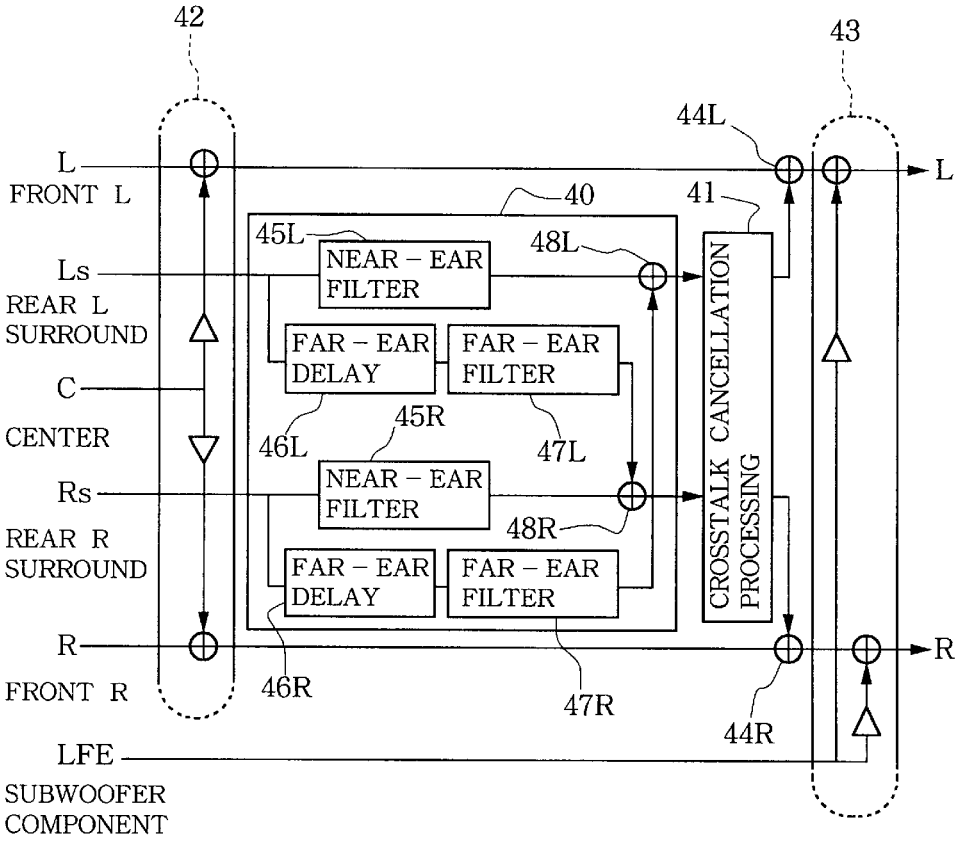

FIGS. 8A and 8B are block diagrams showing an exemplary structure of the USB amplifier unit 3. The USB interface 30 is connected to both a DSP 31 for processing audio signals and a controller 32 for controlling operation of the USB amplifier unit 3. The controller 32 communicates with the personal computer main body 1 via a USB to receive head shape data etc. from the main body 1. Multi-channel audio signals are input via the USB interface 30 to the DSP 31. ROM 33 is connected to the controller 33, and the ROM 33 has stored therein a plurality of sets of filter coefficients, delay times, etc. The controller 33 selects suitable filter coefficients and delay times for simulating head-related transfer functions corresponding to the head shape data input via the USB interface 30, and it reads out the head-related transfer functions from the ROM 33 and sets the read-out head-related transfer functions in the DSP 31.

The DSP 31 combines the multi-channel audio signals, input via the USB interface 30, into two channels using the filter coefficients and delay times and supplies the thus-combined audio signals to a D/A converter (DAC) 35. The D/A converter (DAC) 35 converts the supplied audio signals into analog representation and outputs the converted analog signals to the loudspeakers 4L and 4R.

FIG. 8B is a block diagram showing some of various functions of the DSP 31 which are pertinent to the features of the present invention. In the USB amplifier unit 3, the DSP 31 has, in addition to equalizing and amplifying functions, a function of combining 5.1-channel audio signals into front L and R channels. Here, the function of combining 5.1-channel audio signals into the front L and R channels is described. Addition circuit 42 divides the signal of a center channel C and adds the thus-divided signals to the front L and R channels. Another addition circuit 43 divides the signal for a subwoofer component LFE and adds the thus-divided signals to the front L and R channels. Then, the signals Ls and Rs of the rear L surround channel and rear R surround channel are input to a sound field creation section 40 for purposes to be described.

Figure 9A:
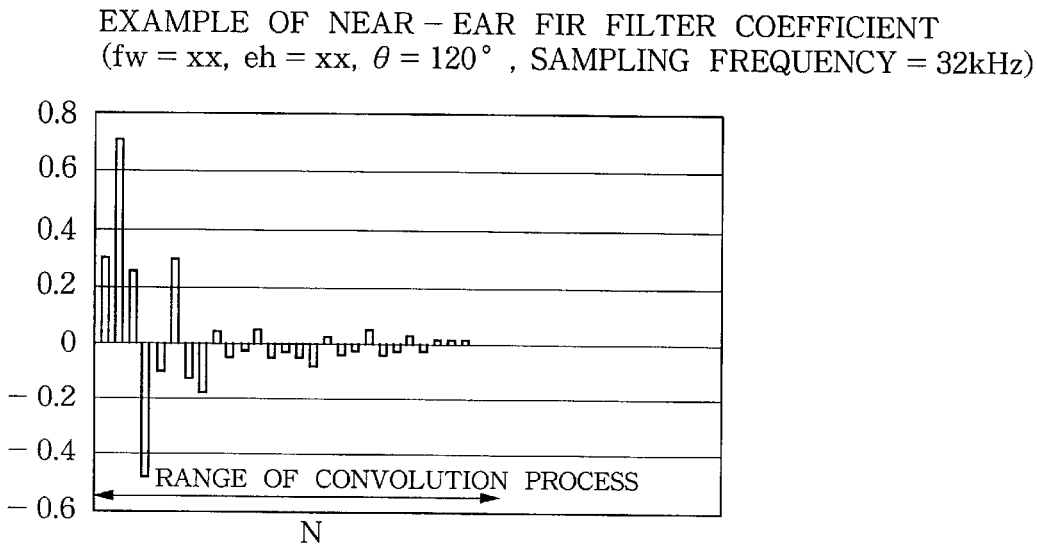
FIGS. 9A and 9B are diagrams showing delay times and filter coefficients to be set in a sound field creation section of the USB amplifier unit.
Figure 9B:
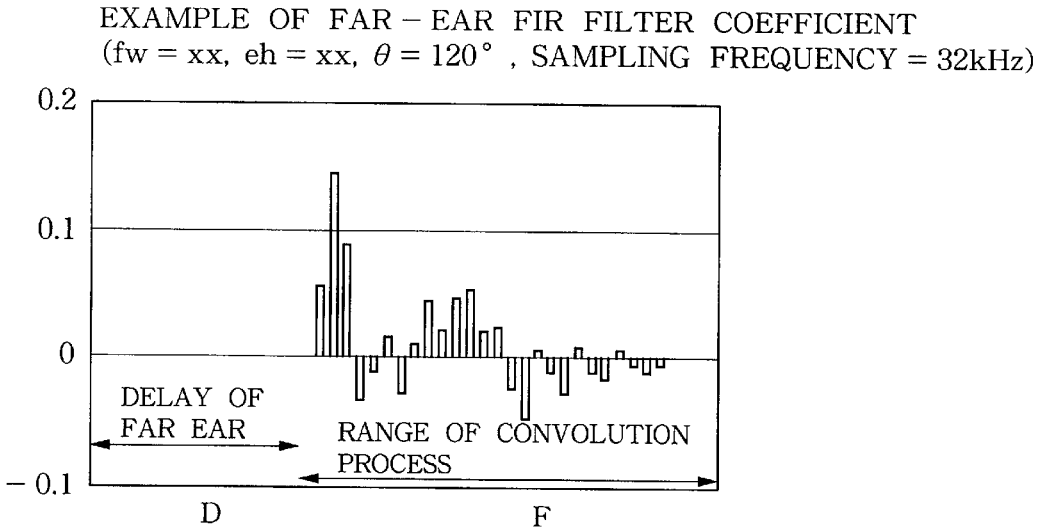

The sound field creation section 40 includes near-ear FIR filters 45L and 45R, far-ear delay sections 46L and 46R, far-ear FIR filters 47L and 47R, and adders 48L and 48R. The above-mentioned controller 32 sets filter coefficients and delay times in the near-ear FIR filters 45L and 45R and far-ear FIR filters 47L and 47R. Filter coefficients within a range denoted by N in FIG. 9A are set in the near-ear FIR filters 45L and 45R. Delay times within a length range denoted by D in FIG. 9B are set in the far-ear delay sections 46L and 46R, and filter coefficients within a range denoted by F in FIG. 9B are set in the far-ear FIR filters 47L and 47R. If sound images of the rear-channel virtual loudspeakers are to be localized, for both of the L and R channels, at the same angle (in horizontal symmetry) from the right-in-front-of-listener direction, the same filter coefficients and delay times may be used for both of the L and R channels; however, If sound images of the rear-channel virtual loudspeakers are to be localized, for the L and R channels, at different angles, different filter coefficients and delay times corresponding to the respective installed angles θ have to be selected.

Each rear L-channel signal Ls is processed by the near-ear FIR filter 45L and then added to the front L channel by way of the adder 48L and a crosstalk cancellation processing section 41. Also, the rear L-channel signal Ls is processed by the far-ear FIR filter 47L after being delayed a predetermined time by the far-ear delay section 46L, and then it is added to the front R channel by way of the adder 48R and crosstalk cancellation processing section 41. In this way, the rear L-channel signal Ls can sound to a human listener as if a sound image corresponding thereto were localized at an angle θ position rearwardly and leftwardly of the human listener, although it is output via the front loudspeakers 4L and 4R. Similarly, each rear R-channel signal Rs is processed by the near-ear FIR filter 45R and then added to the front R channel by way of the adder 48R and crosstalk cancellation processing section 41. Also, the rear R-channel signal Rs is processed by the far-ear FIR filter 47R after being delayed a predetermined time by the far-ear delay section 46R and then added to the front L channel by way of the adder 48L and crosstalk cancellation processing section 41. In this way, the rear R-channel signal Rs can sound to the human listener as if a sound image corresponding thereto were localized at an angle θ position rearwardly and rightwardly of the human listener, although it is output via the front loudspeakers 4L and 4R.

Even where an audio source recorded on a DVD is not of the 5.1-channel audio format, the above-described processing functions can be applied directly if the audio source is converted into the 5.1-channel format via Prologic II (trademark) processing or the like. Also, even if such Prologic II processing is not performed, it suffices to supply signals of the L and R channels to the sound field creation section 40 as signals of the Ls and Rs channels.

In the instant embodiment, the head-related transfer function is obtained in the following manner. The head-related transfer function is a kind of frequency response function derived by handling a sound as a wave and analytically determining what a steady-state sound field produced by driving of an audio source S is like at a sound receiving point P. More specifically, the head-related transfer function indicates, by a numerical value, with which sound pressure balance a given space of interest keeps balance when an audio source present at a given position has vibrated (sounded) at a predetermined frequency within the given space. Specifically, a primitive equation representative of a sound field is solved on the assumption that the sound generating frequency of an audio source is constant (steady-state response analysis), and the sound generating frequency is varied (swept) so as to determine acoustic characteristics of the given space at each of the sound generating frequencies.

The steady-state response analysis employs a boundary integral equation method where a wave equation is applied to a governing equation of the boundary element method. The primitive equation in the method is the Helmholtz-Kirchhoff integral equation, according to which the steady-state sound field at a sound receiving point P in a case where only one spot audio source S steadily vibrates in a sine wave of each frequency ω can be expressed as follows:

[Mathematical Expression 1]

$$\Omega_P\phi(P,\omega) = \Omega_S\phi_D(P,\omega) + \iint_B \left\{ \phi(Q,\omega)\frac{\partial}{\partial n_Q}\left(\frac{e^{-jkr}}{r}\right) - \frac{\partial\phi(Q,\omega)}{\partial n_Q}\frac{e^{-jkr}}{r} \right\} dB_Q$$

Figure 10:
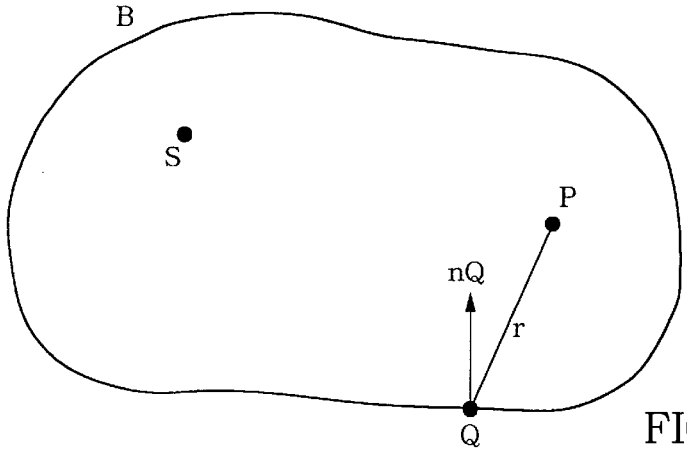
FIG. 10 is a diagram explanatory of a sound filed of which a head-related transfer function is to be analytically determined.

Here, Φ(P) represents a velocity potential at the sound receiving point P, ΦD(P) represents a sound from the audio source S directly received at the receiving point P, nQ represents an inward normal at a point Q present on a boundary B enclosing a space of interest, r represents a distance between the sound receiving point P and the point Q, and k(=ω/c) represents the number of waves (c represents a sound velocity). Further, ΩP and ΩS represent radial solid angles at the sound receiving point P and audio source S, respectively. At each of sound receiving point P and audio source S, the radial solid angle becomes 4π when the point P or audio source S is inside the boundary B, 2π when the point P or audio source S is on the boundary B and 0 when the point P or audio source S is outside the boundary B. Meanings of the other letters and symbols in Mathematical Expression 1 should be clear from an illustrated example of FIG. 10.

Mathematical Expression 1 above can not be worked out as it is because it contains three unknown variables: Φ(P); Φ(Q); and ∂Φ(Q)/∂n(Q). Thus, Mathematical Expression 1 is first changed into an integral equation related to a sound field on the boundary, by placing the sound receiving point P on the boundary. Also, at that time, ∂Φ(Q)/∂n(Q) is expressed as a function of Φ(Q), using a solution to the boundary value problem. These operations can acquire Φ(P) ∈Φ(Q) and ∂Φ(Q)/∂n(Q)=f[Φ(Q)], which leaves only one unknown variable Φ(Q) in the mathematical expression.

The above-mentioned integral equation is called the "second-kind Fredholm integral equation", which can be worked out by an ordinary discretization method. Therefore, in the instant embodiment, the boundary is divided into area elements of dimensions corresponding to the frequency in question (boundary element method), and it is assumed here that the velocity potential is constant at each of the elements. Thus, assuming that the total number of the elements is N, the number of unknown variables in the mathematical expression is also N. Because one equation is derived per element, it is possible to organize simultaneous linear equations of N unknowns. Solving the simultaneous linear equations can determine a sound field on the boundary. Then, by substituting the thus analytically-obtained values into the integral equation of the case where the sound receiving point P is within the space, a sound field analysis for one frequency can be completed.

By carrying out such a sound field analysis a plurality of times while sweeping the frequency, the instant embodiment can acquire a head-related transfer function.

Figure 11:
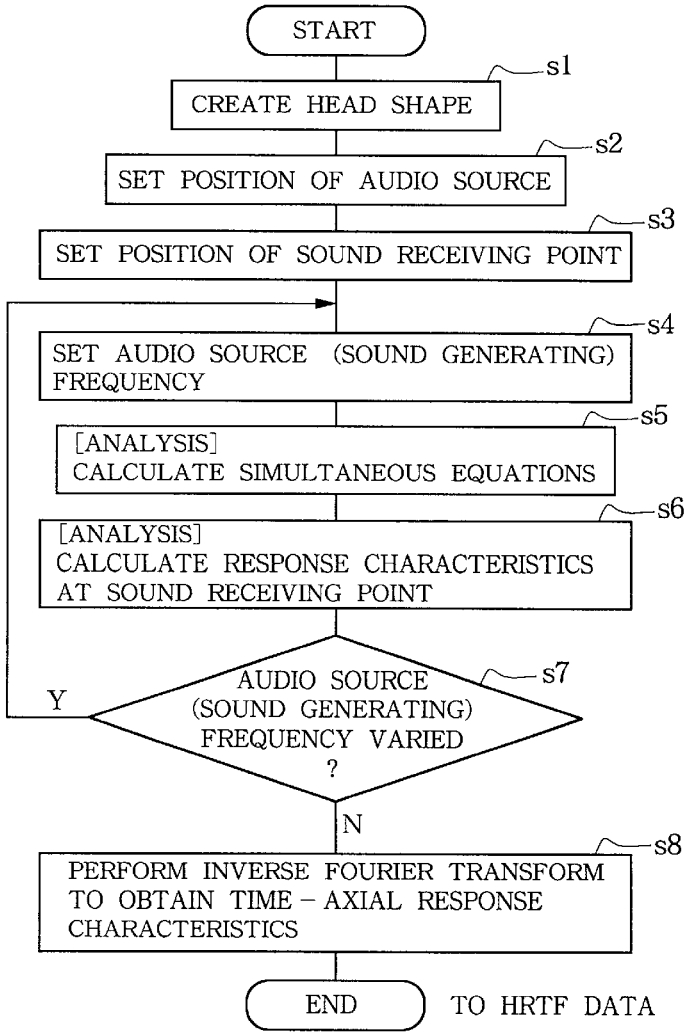
FIG. 11 is a flow chart of a process for calculating a head-related transfer function.
Figure 12A:
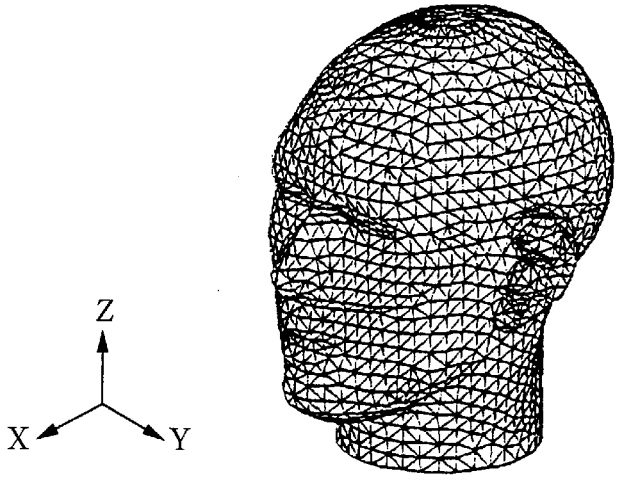
FIGS. 12A to 12C are diagrams explanatory of individual steps of the head-related transfer function calculating process shown in FIG. 11.
Figure 12B:
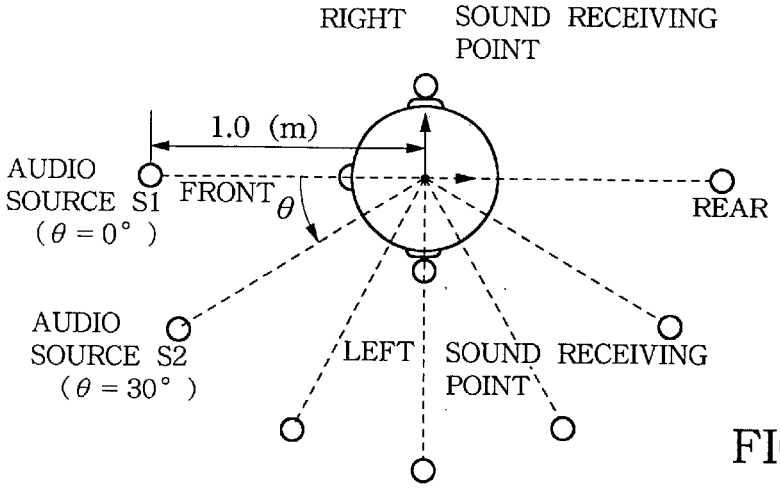

FIG. 11 is a flow chart of a process for determining a head-related transfer function using the above scheme and calculating a filter coefficient and delay time on the basis of the thus-determined head-related transfer function. FIGS. 12A and 12B are diagrams explanatory of individual steps of the process flowcharted in FIG. 11. First, a head shape for determining a head-related transfer function is created as a numerical value model, at step s1 (see FIG. 12A). The thus-created numerical value model is installed in a virtual sound field and positions of an audio source and receiving point are set, at steps s2 and s3 (see FIG. 12B).

Figure 12C:
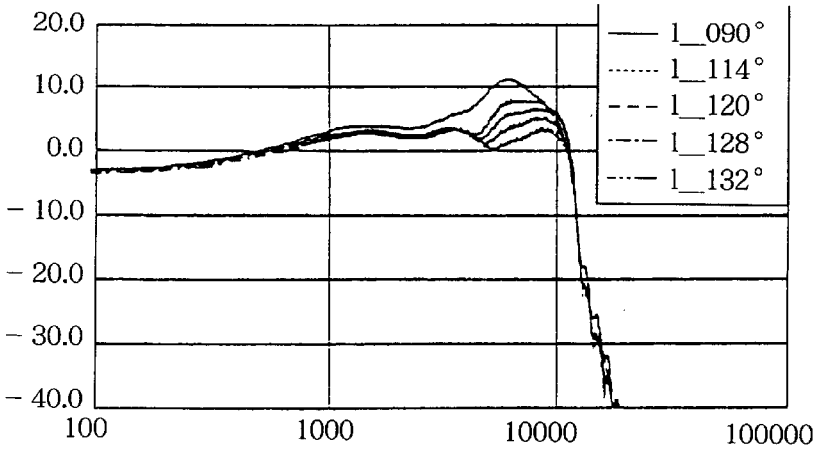

Then, a sound generating frequency ω of the audio source is set at step s4, simultaneous equations are calculated, by applying the above-mentioned conditions to the analysis scheme, to calculate simultaneous equations and thereby determine a sound field on the boundary at step s5, and then response characteristics at the sound receiving point are calculated on the basis of the determined sound field at step s6. By repeating the operations of the above steps a plurality of times while varying the sound generating frequency of the audio source at step s7 (FIG. 12C) and performing the inverse Fourier transform on thus-obtained frequency-axial response characteristics, a time-axial response waveform is obtained at step s8. This time-axial response waveform is set as an FIR filter coefficient.

The above operations can obtain head-related transfer functions and filter coefficients and delay times corresponding to the transfer functions. However, because a great many arithmetic operations and hence a considerably long time are required to calculate the head-related transfer functions and filter coefficients and delay times after head shape data are given, the instant embodiment is arranged to calculate a plurality of sets of filter coefficients and delay times in advance and prestore the thus-calculated sets of filter coefficients and delay times in the ROM 33 of the USB amplifier unit 3. For example, these plurality of sets of filter coefficients and delay times may be calculated in advance by the personal computer main body 1 and stored in the ROM 33 prior to shipment, from a factory or the like, of the amplifier loudspeaker unit. Further, the ROM 33 may be implemented by a flash ROM so as to be rewritten as necessary.

Figure 13:
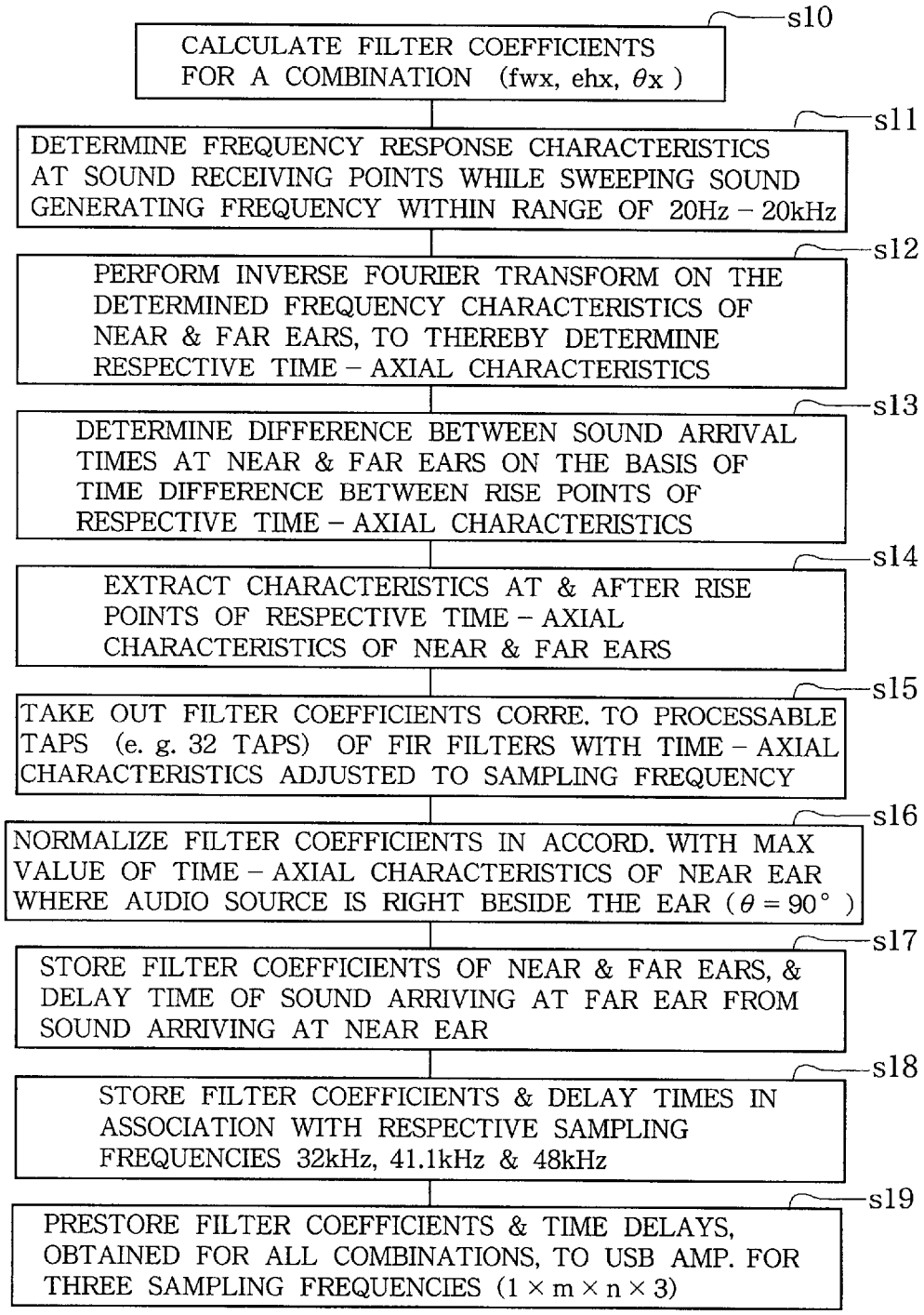
FIG. 13 is a flow chart of a calculation/storage process for calculating a head-related transfer function to be accumulated in the USB amplifier unit.

FIG. 13 is a flow chart of a process for creating data to be written into the USB amplifier unit 3. This process calculates (l×m×n) combinations or sets of filter coefficients and time delays constituted by the face widths fw1-fwl, ear sizes eh1–ehm and angles θ1–θn of the rear surround loudspeaker relative to a right-in-front-of-listener direction, as will be set forth below.

First, a set of parameters (fwx, ehy, θz) are selected at step s10. Then, at step s11, frequency response characteristics, at sound receiving points (near ear position and far ear position), of sounds generated from the θz position are determined by sweeping the sound generating frequency within an audible range of 20 Hz to 20 kHz, using the analysis scheme of FIG. 10. Next, at step s12, the determined frequency response characteristics of the near ear and far ear are subjected to inverse Fourier conversion, to thereby determine their respective time-axial characteristics. After that, a difference between sound arrival times at the near ear and far ear is determined on the basis of a time difference between rise points of the respective time-axial characteristics and the thus-determined sound arrival time difference is set as a delay time D, at step s13. Then, the response characteristics at and after the rise points of the respective time-axial characteristics of the near ear and far ear are extracted at step s14. Then, filter coefficients corresponding to a particular number of processable taps (e.g., 32 taps) of the FIR filter are taken out with the time-axial response characteristics adjusted to a predetermined sampling frequency (step s15), and the taken-out filter coefficients are normalized at step s16. The normalization is performed by converting the time-axial characteristics to filter coefficients so that a greatest possible value of the time-axial response characteristics (e.g., a maximum value of the time-axial characteristics of the near ear where the audio source is located right beside the ear (θ=90°)) equals a maximum value of the filter coefficients and applying the conversion coefficient to all the filter coefficients. The thus-generated filter coefficients are set as filer coefficients N of FIG. 9A and as filer coefficients F of FIG. 9B. At next step s17, these filer coefficients N and F and delay time D are stored as filer coefficients and delay time corresponding to head shape data (fwx, ehy) and angle θz of the rear loudspeaker.

Audio signals to be input to the loudspeaker unit have a plurality of sampling frequencies, such as 32 kHz, 44.1 kHz and 48 kHz. To address such a plurality of sampling frequencies, the operations of steps s15–s17 are carried out for each of the sampling frequencies so that filer coefficients and delay times obtained through these operations are stored in association with the respective sampling frequencies, at step s18.

The above-described operations are executed for each of the (l×m×n) combinations or sets of filter coefficients and time delays constituted by the face widths fw1-fwl, ear sizes eh1-ehm and angles θ1-θn of the rear surround loudspeaker from the right-in-front-of-listener direction. After that, the thus-obtained filer coefficients and delay times are transmitted to the USB amplifier unit 3 at step s19. The USB amplifier unit 3 stores the transmitted filer coefficients and delay times in the ROM 33.

In an alternative, a mask ROM having prestored therein the filer coefficients and delay times obtained through the above-described operations may be set as the ROM 33.

By thus performing a plurality of kinds of arithmetic operations to prepare necessary parameters in advance, the instant embodiment can derive filter coefficients and delay times fit for a head shape of a user (human listener) the instant a face width and ear size (i.e., auricle length) of the listener are detected from a photograph of the listener's face.

Figure 14:
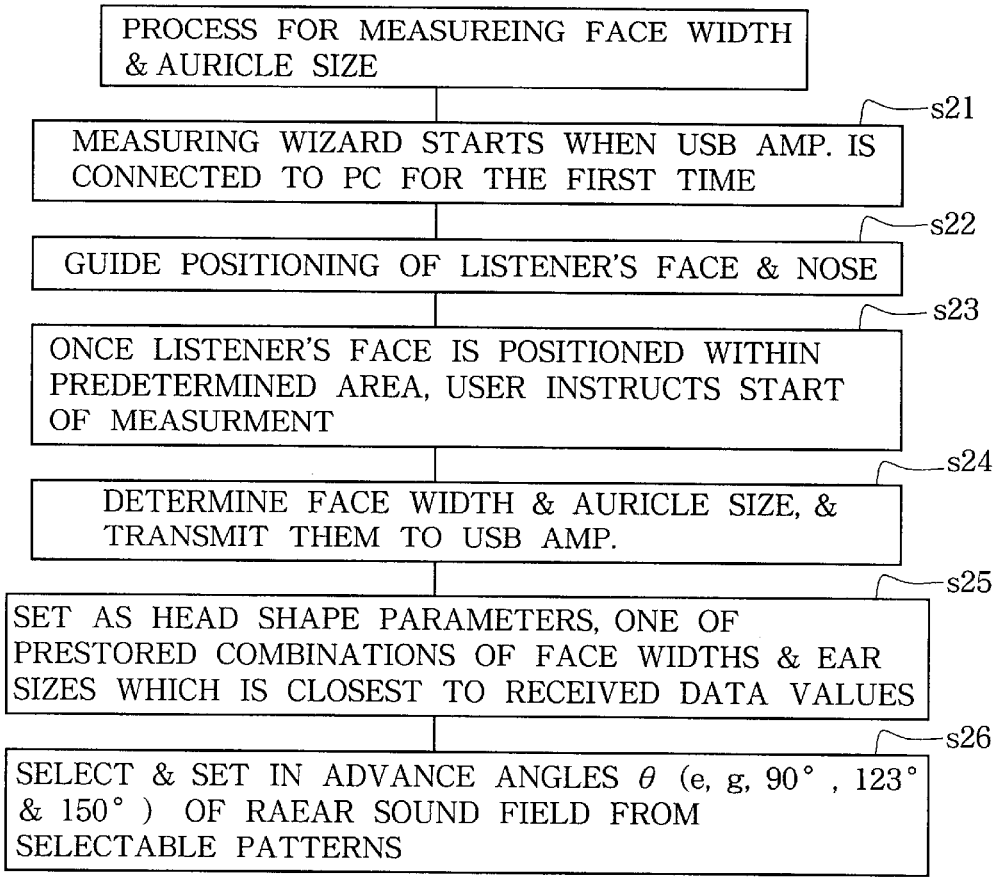
FIG. 14 is a flow chart of a process for deriving and setting head shape data in the USB amplifier unit.

FIG. 14 is a flow chart of a process for setting filter coefficients and delay times by taking a photograph of a listener's face via the CCD camera 5 to derive head shape data of the listener and inputting the head shape data to the USB amplifier unit 3. Further, FIGS. 15A to 15F are diagrams explanatory of identifying a head shape of a human listener. Let it be assumed here that the CCD cameral 5 has an auto-focus function to automatically measure a distance to an object to be photographed (listener's face).

Figure 15A:
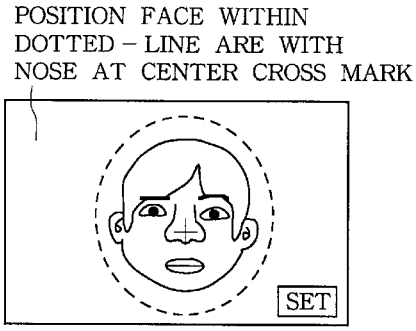
FIGS. 15A to 15F are diagrams explanatory of detecting a head shape and generating head shape data representative of the detected head shape.

The process of FIG. 14 is started up when the USB amplifier unit 3 is connected to the personal computer main body 1 for the first time. First, a wizard screen as illustrated in FIG. 15A is displayed on the monitor 2, at step s21. On this wizard screen, a predetermined area, within which the listener's face should be put, is displayed by a dotted line on the monitor 2 along with the picture being actually taken by the CCD camera 5, and a cross mark is displayed centrally in the predetermined area. Also, at step s22, a message like "please position face within the area enclosed by the dotted-line with nose at the center cross mark" is displayed to guide appropriate positioning of the listener's face. Further, a SET button is displayed along with a message "Please click this button if OK".

Figure 15B:
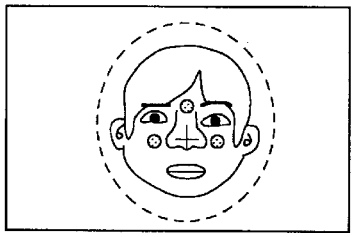
Figure 15C:
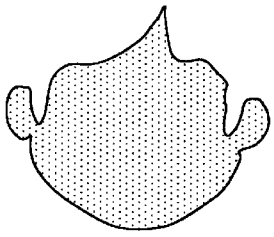

Once the user clicks the SET button after having fixed the face position at step s23, the process starts deriving head shape data (face width and auricle size) by a procedure to be set forth below in relation to FIG. 15B.

Now, a description will be made about a process for deriving head shape data of the human listener, with reference to FIGS. 15A to 15F. Picture taken by the camera 5 and displayed within the dotted-line area on the monitor is captured to extract characteristic features of the picture (see FIG. 15B). Colors (RGB values) of images located at three separate regions of the captured picture, i.e. those located to the left and right of and immediately above the cross mark, are set as skin color distribution values. Then, pixels (picture elements) included in the skin color distribution are extracted (FIG. 15C); in this case, if pixels of continuous areas are extracted, it is possible to avoid extracting sheer unrelated pixels.

Figure 15D:
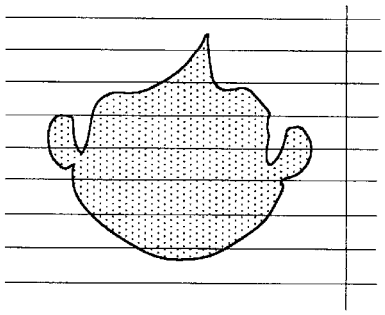
Figure 15E:
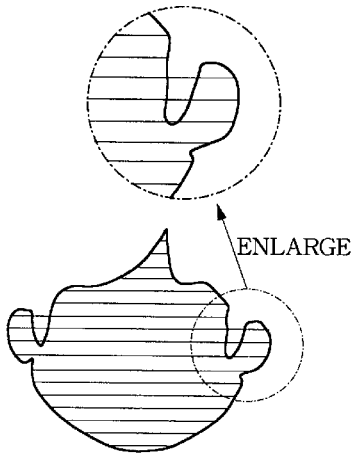
Figure 15F:
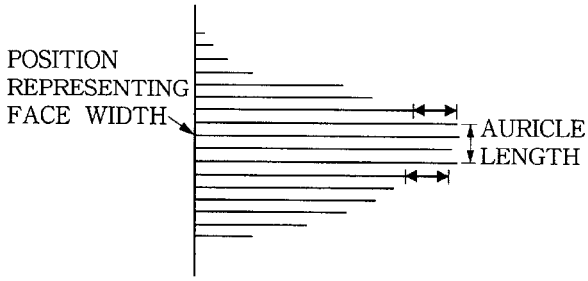

Then, a raster scan is performed in a y-axis direction within the extracted range of the face, so as to detect a raster having a longest continuous row of pixels in an x-axis direction. The number of pixels in the longest continuous row in the x-axis direction is set as a width of the face (FIG. 15D). FIG. 15F is a graph showing numbers of pixels present in all of the x-axis rasters. Although an image of a listener's auricle may present some discontinuity, the image is processed as continuous (as having successive pixels) if there are other pixels outwardly of the discontinued region (see an encircled section of FIG. 15E). If the numbers of successive pixels in the x-axis rasters are expressed in a histogram, it will be seen that the numbers of successive pixels in a region corresponding to the position of the auricle present stepwise or discrete increases. Size (i.e., length) of the auricle can be identified by counting the number of the rasters present in the y-axis direction of the discretely-increasing region.

Thus, the above operations can derive the face width and auricle size in terms of the numbers of pixels (picture elements or dots). Actual face width and auricle size can be determined accurately by a size of each dot (scale coefficient) calculated with reference to a distance between the cameral and the user.

Referring back to the flow chart of FIG. 14, data of the thus-determined face width and auricle size are transmitted to the USB amplifier unit 3 at step s24. In turn, the USB amplifier unit 3 selects one of a plurality of prestored combinations of face widths fw and ear sizes eh which is closest to values represented by the transmitted (received) data, and then it sets, in the sound field creation section 40, filter coefficients and delay times corresponding to the selected combination (step s25).

Note that the angle θ at which the rear loudspeaker should be localized is set to 120° by default for each of the front L and R channels. If desired, the user can manually change the default angle θ using the remote controller 6 or the like. Further, in the instant embodiment, the USB amplifier unit 3 is arranged to detect the sampling frequency of each input audio signal and automatically adjust itself to the detected sampling frequency.

The embodiment has been described so far as photographing a human listener's face by means of a camera connected to a personal computer system that reproduces multi-channel audios and then deriving head shape data from the photograph. Alternatively, head shape data derived by another desired type of device, apparatus or system may be set in the audio system. For example, head shape data derived by another desired device than a camera may be manually input to the audio system. Such head shape data may be stored in a storage medium so that the head shape data can be input to and set in the audio system by installing the storage medium in the audio system. Further, the picture of the listener's face may be transmitted by the audio system to an Internet site so that the Internet site can derive head shape data of the listener from the picture and send the head shape data back to the audio system.

Further, the embodiment has been described above as storing sets of filter coefficients and delay times in the USB amplifier unit 3. Alternatively, such sets of filter coefficients and delay times may be prestored in the personal computer main body 1 so that one of the sets of filter coefficients and delay times, corresponding to derived head shape data, can be transmitted to the USB amplifier unit 3. Where the personal computer main body 1 has a high arithmetic processing capability, it may calculate head-related transfer functions corresponding to derived head shape data on the spot to thereby acquire filter coefficients and delay times and transmit the these filter coefficients and delay times to the USB amplifier unit 3.

Furthermore, whereas the embodiment has been described as using data of a listener's face width and auricle size as head shape data, any other suitable data may be used as the head shape data. For example, data indicative of an amount of the listener's hair, listener's hairstyle, dimension, in a front-and-rear direction, of the listener's face, three-dimensional shape of the face (height of the nose, roundness of the face, shape balance of the face, smoothness of the face surface, etc.), hardness (resiliency) of the face smooth, etc. may be used as the head shape data. Moreover, the filter unit to be used for simulating a head-related transfer function is not limited to a combination of FIR filters and delay sections as described above. Furthermore, the parameters to be used for simulating a head-related transfer function are not limited to filter coefficients and delay times.

In summary, the present invention arranged in the above-described manner can detect a head shape of a human listener and set filter coefficients optimal to the detected head shape. Thus, even where audio signals of a rear channel are output via front loudspeakers, the present invention allows the rear-channel audio signal to be localized appropriately at a virtual rear loudspeaker and can thereby produce a sound field full of presence or realism.

The present invention relates to the subject matter of Japanese Patent Application No. 2002-027094 filed Feb. 4, 2002, the disclosure of which is expressly incorporated herein by reference in its entirety.

What is claimed is:

1. An audio amplifier unit comprising:

a filter section that receives multi-channel audio signals including at least audio signals of front left, and front right and rear channels and performs a filter process on the audio signal of the rear channels so as to allow the audio signal of the rear channel to be virtually localized at a virtual loudspeaker position of the rear channels;

a head shape detection section that detects a head shape of the listener to generate head shape data;

a filter coefficient supply section that supplies said filter section with filter coefficients for simulating characteristics of sound transfer from the virtual loudspeaker position of the rear channels to ears of the listener, the characteristics corresponding to the head shape data generated by said head shape detection section; and an output section that provides an output of the filter section to a pair of loudspeakers for front left and right channels.

2. An audio amplifier unit as claimed in claim 1 wherein the head shape data represents data represents a face width and auricle size of the listener.

3. An audio amplifier unit as claimed in claim 1 wherein said head shape detection section includes a camera for taking a picture of a face of the listener, and a picture processing section that extracts predetermined head shape data from the picture of the face taken by said camera.

4. An audio amplifier unit as claimed in claim 1 wherein said head shape detection section is provided in a personal computer externally connected to said audio amplifier unit, and the personal computer supplies the multi-channel audio signals to said audio amplifier unit.

5. An audio amplifier unit comprising:

filter means for receiving multi-channel audio signals including at least audio signals of front left, and front right and rear channels and performing a filter process on the audio signal of the rear channel so as to allow the audio signal of the rear channels to be virtually localized at a virtual loudspeaker position of the rear channels;

head shape detecting means for detecting a head shape of the listener to generate head shape data;

filter coefficient supplying means for supplying said filter means with filter coefficients for simulating characteristics of sound transfer from the virtual loudspeaker position of the rear channels to ears of the listener, the characteristics corresponding to the head shape data generated by said head shape detecting means; and output means for providing an output of the filter means to a pair of loudspeakers for front left and right channels.

6. An audio amplifier unit as claimed in claim 5 wherein the head shape data represents data represents a face width and auricle size of the listener.

7. An audio amplifier unit as claimed in claim 5 wherein said head shape detecting means includes a camera for taking a picture of a face of the listener, and picture processing means for extracting predetermined head shape data from the picture of the face taken by said camera.

8. An audio amplifier unit as claimed in claim 5 wherein said head shape detecting means is provided in a personal computer externally connected to said audio amplifier unit, and the personal computer supplies the multi-channel audio signals to said audio amplifier unit.

9. A method for localizing a sound image of a rear-channel audio signal at a virtual rear-channel loudspeaker position comprising steps of:

providing multi-channel audio signals including at least audio signals of front left, front right and rear channels to a filter for causing the filter to perform a filter process on the audio signal of the rear channel so as to allow the audio signal of the rear channels to be virtually localized at a virtual loudspeaker position of the rear channels;

detecting a head shape of a listener and generating head shape data;

supplying the filter with filter coefficients for simulating characteristics of sound transfer from the virtual loudspeaker position of the rear channels to ears of the listener, the characteristics corresponding to the head shape data; and supplying an output of the filter to a pair of loudspeakers for front left and right channels.

* * * * *